US006591447B2

(12) United States Patent
Wegelin et al.

(10) Patent No.: US 6,591,447 B2
(45) Date of Patent: Jul. 15, 2003

(54) SPRING LOADED VACUUM CLEANER NOZZLE

(75) Inventors: Jackson W. Wegelin, Akron, OH (US); Kurt D. Harsh, North Canton, OH (US); Ryan S. Steiner, Dalton, OH (US)

(73) Assignee: The Hoover Company, North Canton, OH (US)

( * ) Notice: Subject to any disclaimer, the term of this patent is extended or adjusted under 35 U.S.C. 154(b) by 104 days.

(21) Appl. No.: 09/811,893

(22) Filed: Mar. 19, 2001

(65) Prior Publication Data

US 2002/0129461 A1 Sep. 19, 2002

(51) Int. Cl.[7] ..... A47L 5/34
(52) U.S. Cl. ..... 15/359; 15/361; 15/371
(58) Field of Search ..... 15/354, 359, 361, 15/410, 371

(56) References Cited

U.S. PATENT DOCUMENTS 2,291,250 A * 7/1942 Neilsen et al. ..... 15/359
2,856,628 A * 10/1958 Vance ..... 15/359
2,874,400 A * 2/1959 Burrage ..... 15/359
2,898,621 A * 8/1959 Vance
3,358,316 A * 12/1967 Okun ..... 15/352
3,676,892 A 7/1972 Nordeen
3,827,103 A * 8/1974 Nordeen et al. ..... 15/359
5,353,471 A * 10/1994 Guhne et al. ..... 15/339
5,819,370 A 10/1998 Stein

FOREIGN PATENT DOCUMENTS

| | | |
|---|---|---|
| EP | 727171 A2 | 8/1996 |
| EP | 727171 A3 | 7/1998 |
| EP | 727171 B1 | 1/2001 |

OTHER PUBLICATIONS

U.S. patent application No. 2002/0124344 A1 filed Mar. 5, 2002 by Nishikori et al.

* cited by examiner

*Primary Examiner*—Chris K. Moore
(74) *Attorney, Agent, or Firm*—A. Burgess Lowe; Michael J. Corrigan

(57) ABSTRACT

A vacuum cleaner of the fixed or floating nozzle type wherein a spring is utilized for urging the suction nozzle into the carpet pile to maintain and improve nozzle suction over a wide range of carpet pile heights and types. Such cleaners often lose nozzle suction as the pile height of the carpet increases and forces the suction nozzle upward away from the carpet. The addition of a spring to force the suction nozzle downward restores and improves nozzle suction and thereby improves overall cleaning efficiency of the vacuum cleaner.

32 Claims, 16 Drawing Sheets

SPRING LOADED VACUUM CLEANER NOZZLE

BACKGROUND OF THE INVENTION

1. Technical Field

The invention pertains to a spring loaded nozzle arrangement for increasing the loading on the nozzle for improved cleaning performance.

2. Background Information

Upright vacuum cleaners are well known in the art. Typically, these upright vacuum cleaners include a vacuum cleaner housing pivotally mounted to a vacuum cleaner foot. The foot is formed with a nozzle opening and may include an agitator mounted therein for loosening dirt and debris from a floor surface. A motor may be mounted in either the foot or the housing for producing suction at the nozzle opening. The suction at the nozzle opening picks up the loosened dirt and debris and produces a stream of dirt-laden air which is ducted to the vacuum cleaner housing for collection and later disposal.

In conventional vacuum cleaners, the nozzle is suspended over the floor surface to be cleaned so that a pre-determined distance is maintained. Typically, the cleaner wheels are positioned so that the nozzle is supported above the floor surface the desired distance. The distance is selected so that nozzle suction is maintained on the floor surface to be cleaned while allowing air flow into the suction nozzle. Both nozzle suction and air flow into the nozzle are necessary for satisfactory cleaning efficiency. The distance the nozzle needs to be suspended over the surface to be cleaned to maintain satisfactory nozzle suction and air flow varies according to the type of carpeting and the pile height. Some cleaners allow this distance to be adjusted for varying carpet pile heights by the user moving a knob or dial on the foot of the cleaner. However, this isn't completely satisfactory since such cleaners don't have a setting to accommodate every carpet pile height. One setting may be too high and the next lower setting may be too low. Even when a cleaner is set to a lower setting, nozzle suction is lost because the underside of the nozzle has a tendency to be lifted from the carpet by the thicker pile. Hence, cleaning efficiency is reduced. It has been found that loading the nozzle with weight or the equivalent forces the nozzle deeper into the pile of the carpet and nozzle suction is improved. Thus, cleaning efficiency may be maintained on carpets of all pile heights.

There exists in the prior art patents for a vacuum cleaner having a spring means to urge the nozzle towards the floor surface. For example, U.S. Pat. No. 3,676,892 issued to Nordeen discloses a vacuum cleaner having an elongated floor portion propellable over a floor during cleaning and supported on the floor by a plurality of spaced front and rear wheels. A nozzle unit forms the floor portion of the cleaner and has a front suction opening end carrying a floor contacting brush and is rockable or pivotable in a vertical direction with respect to the wheels. A first spring means constantly urges the carriage downwardly at the front end to hold the brush in a cleaning position with respect to the floor regardless of the nature of the floor or its covering. A propelling handle is rockably attached to the cleaner and movable between an operating position and a storage position. A second spring means stronger than the first and operably positioned between the front wheels and the front is operably positioned between the front wheels and the front suction end of the nozzle unit. Means operated by the handle when the handle is moved to the storage position distorts the second spring means to apply an overcoming spring force to retain the nozzle unit front end away from the floor against the urging of the first spring means. The cleaner can then be operated in the customary off-the-floor cleaning of furniture, draperies and the like by the use of auxiliary equipment without permitting the brush to contact the floor.

U.S. Pat. No. 5,819,370 issued to Stein and the corresponding foreign patent publications, namely, Federal Republic of Germany Patent Application No. 195 05 106.8, filed on Feb. 16, 1995, DE-OS 195 05 106.8, and DE-PS 195 05 106.8, and European Patent Applications EP 0 727 171 A3 and EP 0 727 171 A3 describe a floorcare machine wherein the brush roller is pressed against the surface to be cleaned by a means of a spring element. The brush roller is pivotally mounted in the housing and is biased against the floor surface by means of a tension spring, or alternately, a torsional spring. The tension spring biases the roller toward the floor surface being operatively connected at the rear of the housing between the top of the housing and the inner part the roller is rollably mounted within. The torsional spring biases the roller downward toward the floor surface by being operatively mounted about the pivot the inner part is mounted onto the housing with.

However, neither of these references describe a vacuum cleaner having a means for urging the nozzle toward the surface to be cleaned and selectively allowing the user to adjust the height in which the nozzle is suspended over the floor surface. Consequently, there is a need in the art for a new and improved arrangement for loading a vacuum cleaner nozzle that also has a means to select the height which the nozzle is suspended over the carpet or surface to be cleaned while simultaneously urging the nozzle into the carpet pile regardless of the height of the carpet pile. The present invention fulfills this need by providing a vacuum cleaner having a means for adjusting the distance the nozzle is suspended over the carpet or surface to be cleaned while maintaining a biasing force on the nozzle to continuously urge the nozzle into the carpet pile regardless of the carper pile height.

Accordingly, an object of the present invention is to provide a spring loaded nozzle for a vacuum cleaner for improving cleaning performance on carpets of varying pile heights.

Another object of the present invention is to provide a spring loaded nozzle to improve nozzle suction while maintaining satisfactory air flow into the nozzle.

Yet another object of the present invention is to provide a spring loaded nozzle for suction nozzles of the fixed type.

Still yet another object of the present invention is to provide a spring loaded nozzle for suction nozzles of the floating type.

These and other objects will be readily apparent to one of skill in the art upon reviewing the following description and accompanying drawings.

SUMMARY OF THE INVENTION

In the preferred embodiment of the present invention, an upright vacuum cleaner is provided of the floating nozzle type. Such cleaners are typically comprised of an upright portion pivotally connected to a vacuum cleaner foot. The foot is generally comprised of a main body, an agitator housing pivotally connected to the main body, an agitator mounted within the agitator housing, and a hood covering the foot. The agitator housing is biased downward by a spring member such as a compression spring in operative engagement with the agitator housing to urge the nozzle towards the surface to be cleaned or the carpet pile. The vacuum cleaner may or not have a power drive unit in the foot to propel the foot over the floor surface In an alternate preferred embodiment of the present invention, an upright vacuum cleaner is provided of the fixed nozzle type. Such cleaners are typically comprised of an upright portion pivotally connected to a vacuum cleaner foot. The foot is generally comprised of an agitator housing and an agitator mounted within the agitator housing. The vacuum cleaner may or not have a power drive unit in the foot to propel the foot over the floor surface. A least one spring member such as a coil spring or torsional spring is in operative engagement with the upper portion of the vacuum cleaner and the foot to urge the agitator housing and the nozzle towards the surface to be cleaned or the carpet pile. The vacuum cleaner may or not have a power drive unit in the foot to propel the foot over the floor surface

DESCRIPTION OF THE PREFERRED EMBODIMENT

Figure 1:
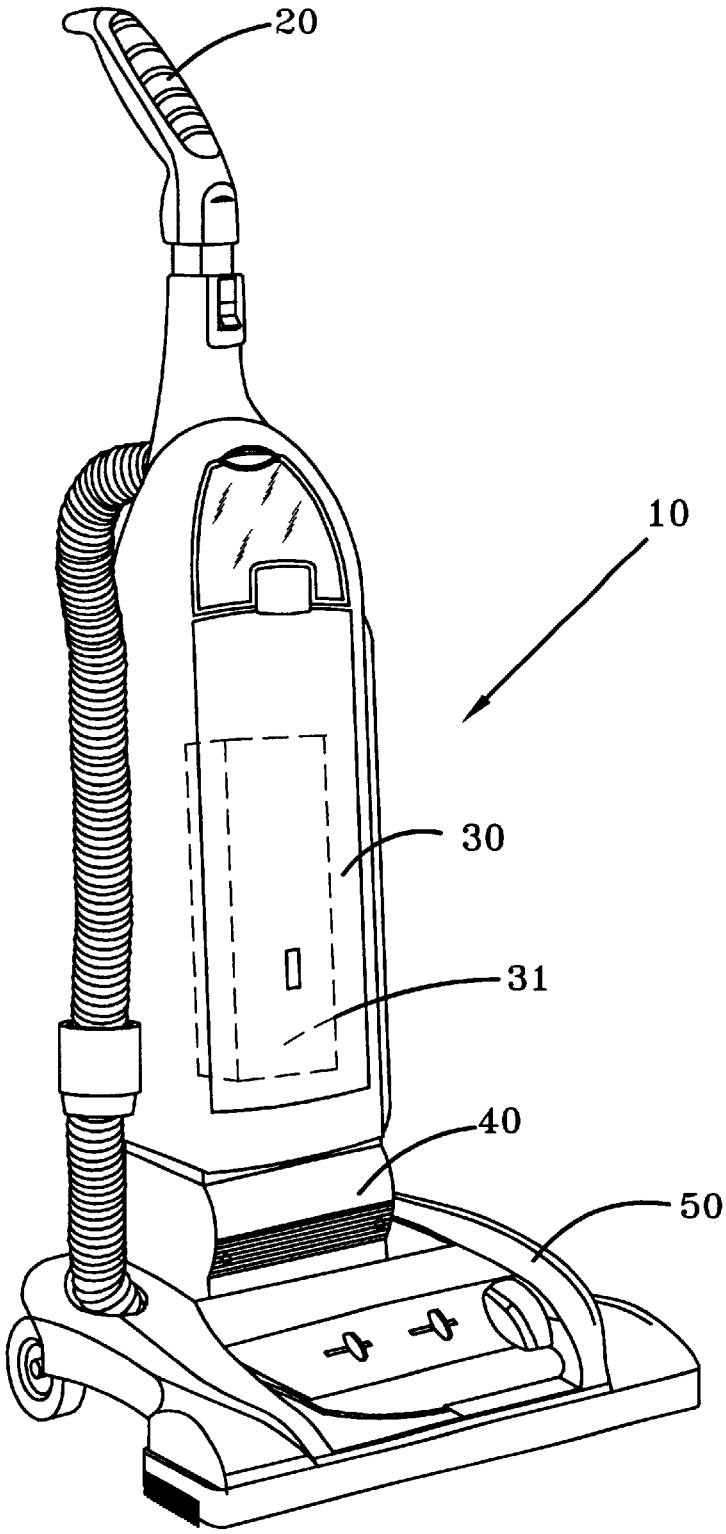
FIG. 1 is a perspective view of a vacuum cleaner of the floating nozzle type, according to one embodiment of the present invention.
Figure 2A:
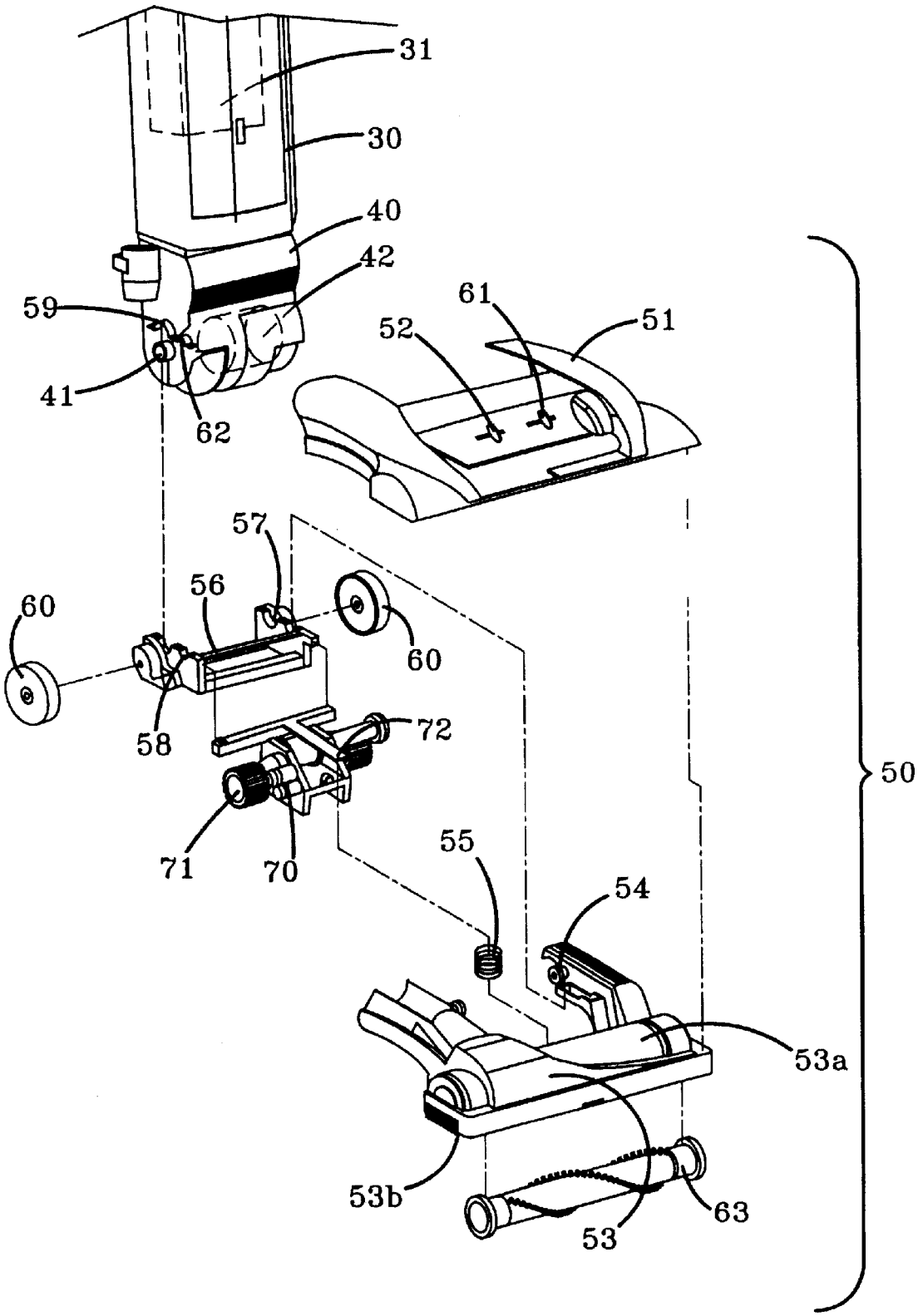
FIG. 2A is an exploded perspective view of the lower portion of the vacuum cleaner shown in FIG. 1.
Figure 2B:
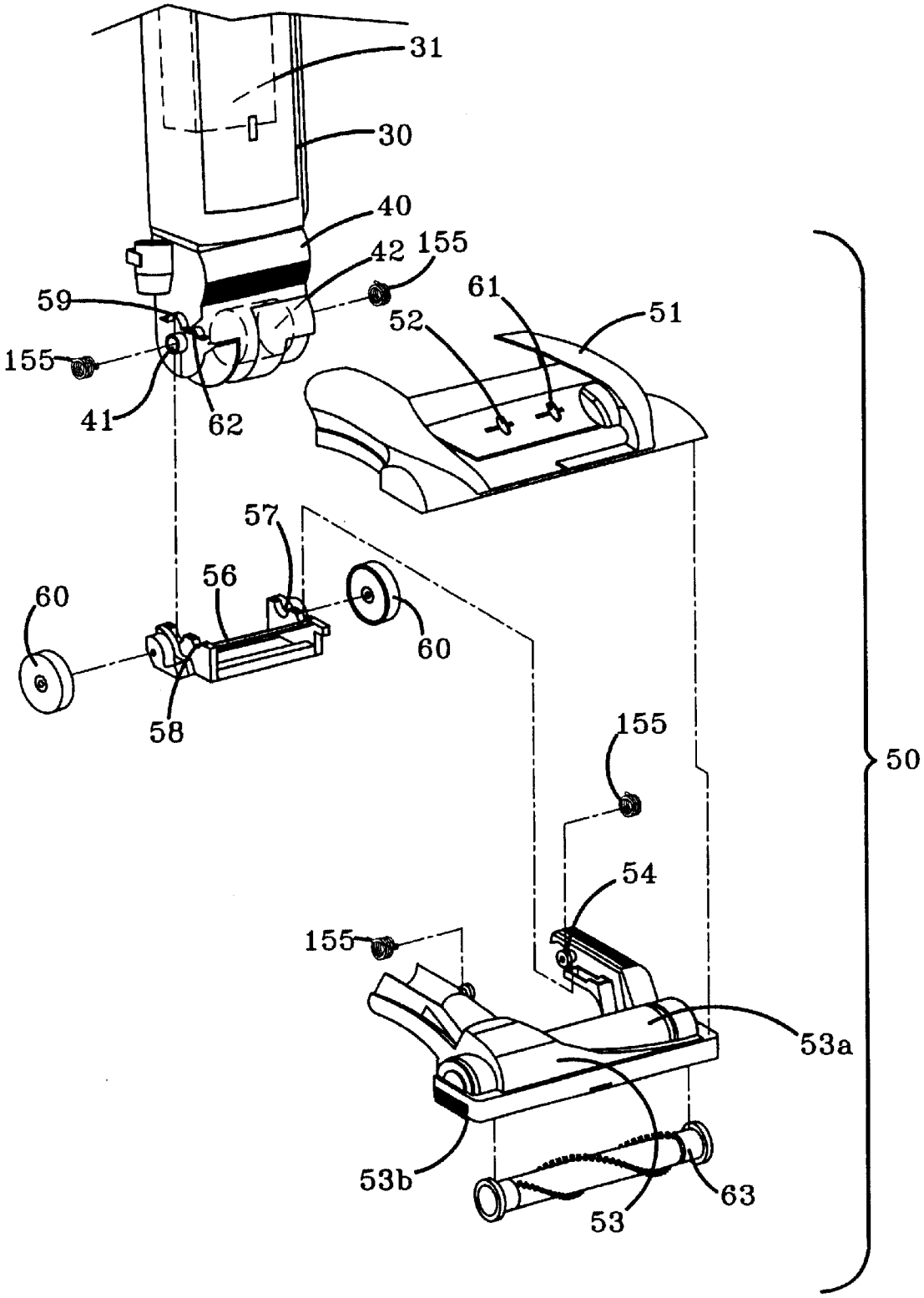
FIG. 2B is an exploded perspective view of the lower portion of a vacuum cleaner like the one shown in FIG. 1, according to the third embodiment of the invention.
Figure 2C:
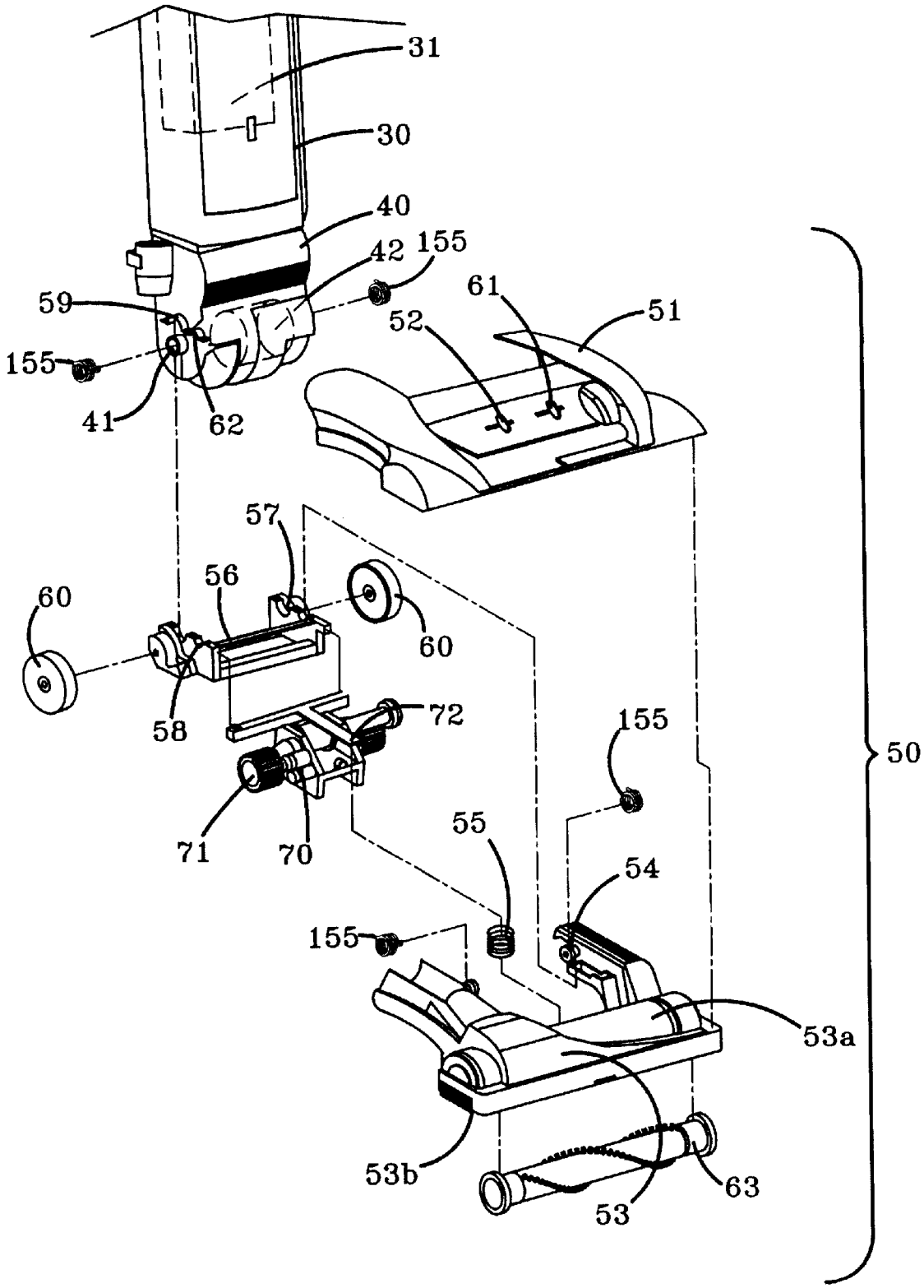
FIG. 2C is an exploded perspective view of the lower portion of a vacuum cleaner like the one shown in FIG. 1, according to the fourth embodiment of the invention.
Figure 2D:
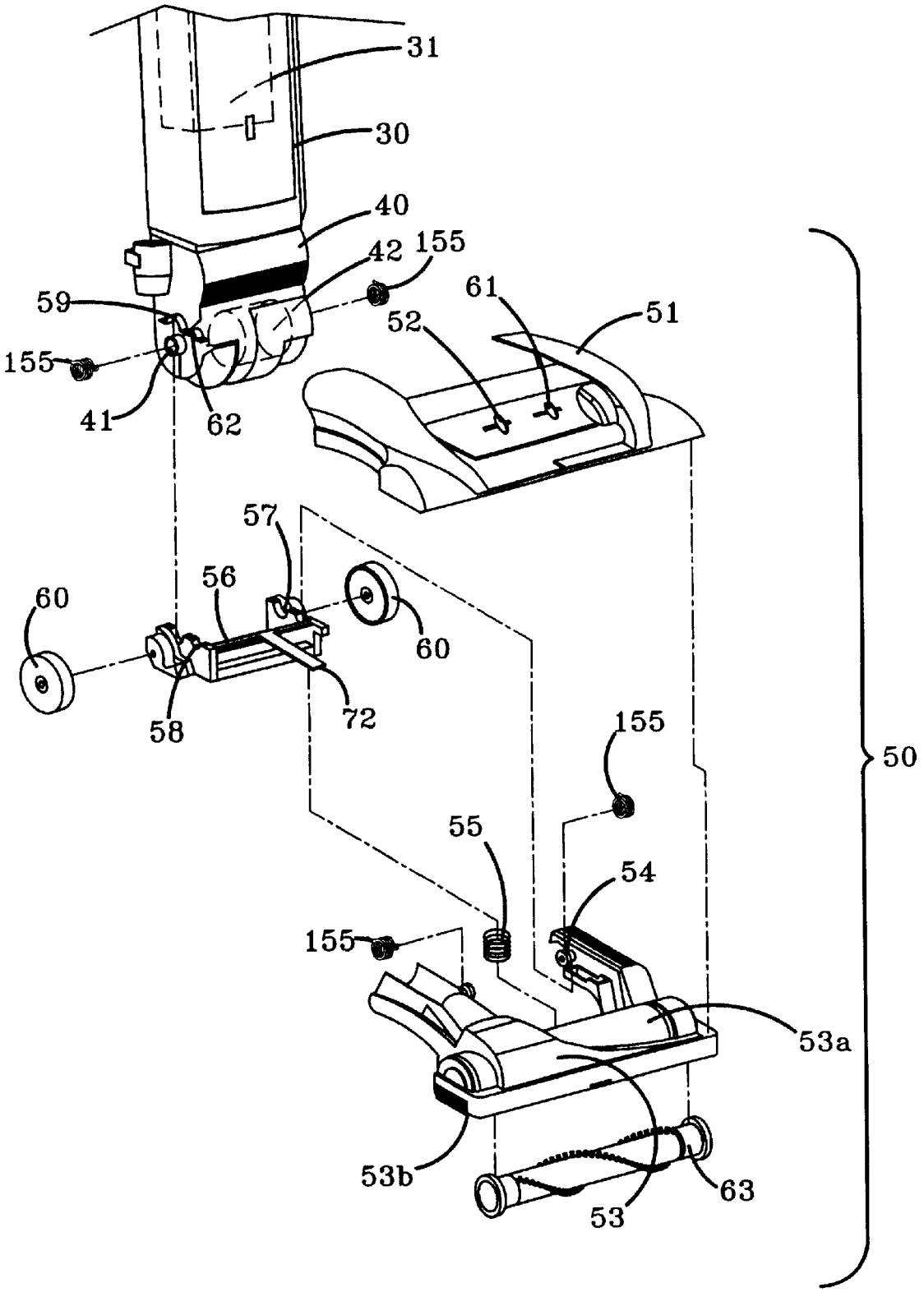
FIG. 2D is an exploded perspective view of the lower portion of a vacuum cleaner like the one shown in FIG. 1, according to the fifth embodiment of the invention.
Figure 2E:
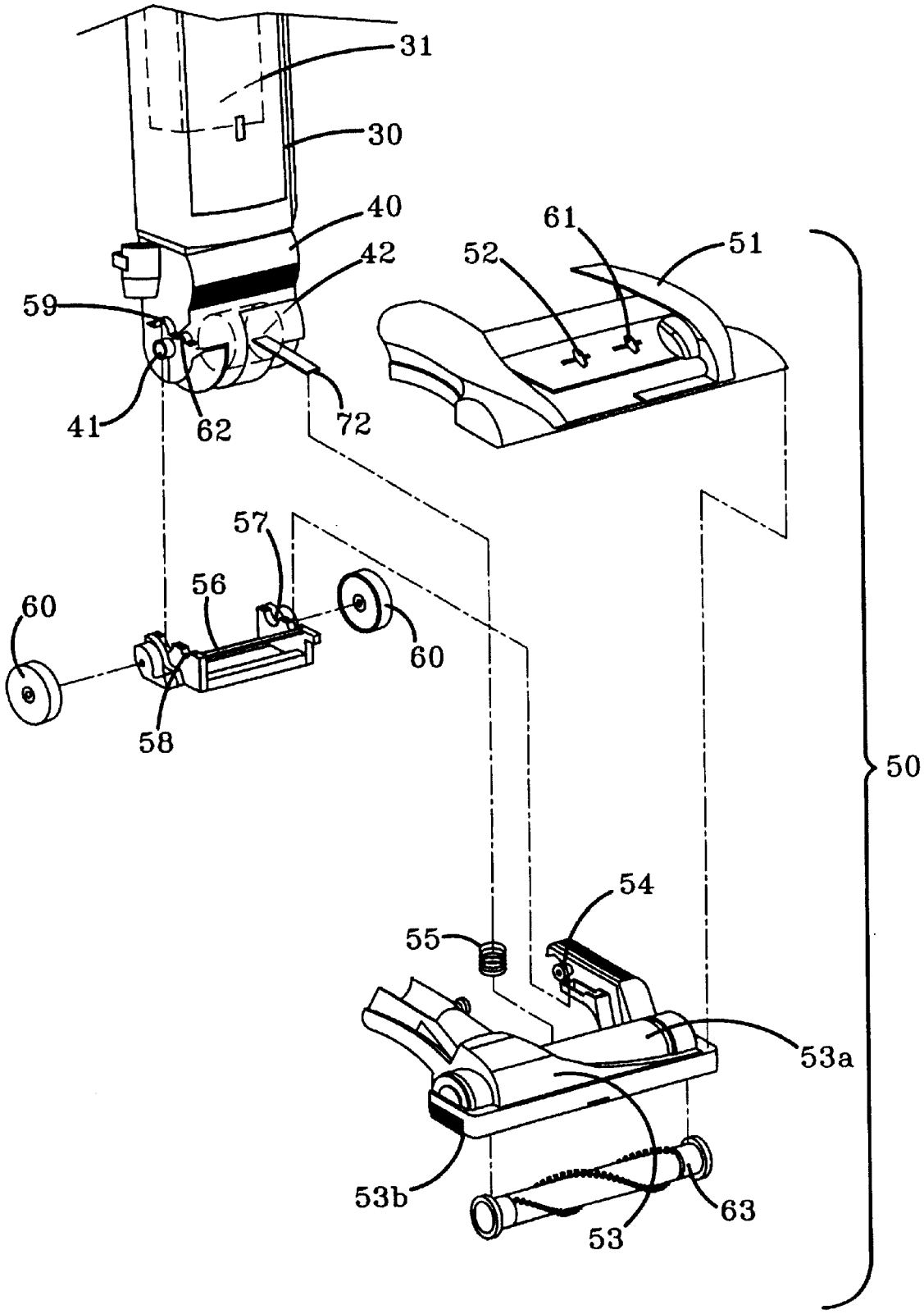
FIG. 2E is an exploded perspective view of the lower portion of a vacuum cleaner like the one shown in FIG. 1, according to the sixth embodiment of the invention.

A vacuum cleaner having a spring-loaded nozzle of the floating nozzle type is shown in FIG. 1 and generally indicated as 10, according to the preferred embodiment of the present invention. The cleaner 10 shown is an upright vacuum cleaner but the scope of the invention in the preferred embodiment also includes other vacuum cleaners having a floating suction nozzle, including but not limited to, canister vacuums. Vacuum cleaner 10 includes a handle 20, a bag housing 30, and a vacuum cleaner foot 50. A source of suction such as suction fan motor (not shown) is enclosed in a motor housing 40 located on the lower end of the bag housing 30. Vacuum cleaner foot 50 is pivotally connected to bag housing 30 via motor housing 40. Bag housing 30 holds a filter media and receptacle 31 for filtering and collecting particulate matter from an airstream drawn through a suction nozzle inlet area (not shown) on the underside of foot 50 by the suction motor. In the preferred embodiment of the invention, the filter media and receptacle 31 located within bag housing 30 is a filter bag. In an alternate embodiment of the present invention, the filter media and receptacle 31 are cyclonic action which deposits particulate matter into a receptacle such as a dirt cup for later disposal. The suction nozzle inlet opening (not shown) opens toward the floor surface to be cleaned. A conventional agitator (not shown) is positioned within an agitator chamber (not shown) which communicates with the nozzle opening inlet area. The agitator rotates about a horizontal axis for loosening dirt and particles from the floor surface and carpet for collection and later disposal. The agitator may be rotated by the suction-fan motor or other rotary power source.

Referring now to FIGS. 2 and 3, foot 50 is comprised of a hood 51 and agitator housing 53 which is pivotally connected to main body 56. Bag housing 30 holds a filter media and receptacle 31 for filtering and collecting particulate matter from an airstream drawn into agitator chamber 53*a* through a suction nozzle inlet area 53*b* on the underside of foot 50 created by the suction motor 42. In the preferred embodiment of the invention, filter media and receptacle 31 is a filter bag. In an alternate embodiment of the invention, filter media and receptacle 31 may be a dirt cup which removes the particles from the airstream by cyclonic action. In another alternate embodiment of the invention, filter media and receptacle 31 may be a dirt cup having a filter located therein for filtering particles. Main body 56 has a pair of opposing semi-circular shaped recesses 57 for receiving a complementary pair of opposing trunnions 41 located on motor housing 40. A trunnion cover 59 secures each of opposing trunnions 41 within recesses 57 of main body 56. Trunnion covers 59 are secured using screws or the like. A pair of wheels 60 are located on opposing sides of main body 56 for supporting main body 56 on a surface to be cleaned.

Connected to the front side of main body 56 is power drive unit 70 having a pair of opposing drive wheels 71 for propelling foot 50 on a surface and supporting main body 56 on the surface. Power drive unit 70 may be powered by the suction-fan motor 42 or other source of rotary power. As is typical with power drive units such as the one shown, a linkage or other member from the handle 20 (shown in FIG. 1) causes the rotary power to be selectively connected to the power drive unit 70.

Agitator housing 53 is pivotally connected to main body 56 via a pair of inwardly facing opposing pivots 54 located on agitator housing 53. Pivots 54 are received by a complementary pair of pivot recesses 58 located on main body 56. Pivot recesses 58 are semi-circular shaped so that pivots 54 may rotate freely therein. A second pair of trunnion covers 62 secure pivots 54 in pivot recesses 58. Agitator housing 53 and hood 51 are thereby free to pivot relative to main body 56 as a unit. Power drive unit 70 is designed to fit within a open region between the lateral sides of agitator housing 53. Since power drive unit 70 is fixed rigidly to main body 56, agitator housing 53 is free to move relative to power drive unit 70. A loading spring arm 72 projects forwardly from power drive unit 70 over onto the upper surface of agitator housing 53. At the free end of loading spring arm 72, a compression spring 55 is inserted between the lower side of loading spring arm 72 and the upper surface of agitator housing 40. The upper side of loading spring arm 72 bears against the underside of carpet height selector 53 positioned in a track in hood 51. The underside of carpet height selector 52 is cammed so that as carpet height selector 52 is moved laterally the amount of force applied to loading spring arm 72 is varied. This arrangement allows a varying amount of force to be applied to the upper surface of agitator housing 53 to force agitator housing 53 in the direction of arrow 80 into the carpet pile to maintain nozzle suction. When vacuum cleaner 10 is in use, there is a tendency for agitator housing 53 to be lifted from the carpet as the carpet pile height increases thereby reducing nozzle suction and cleaning efficiency. As the height of the carpet pile increases, more force may be applied to agitator housing 53 by compression spring 55 by adjusting the position of carpet height selector 52. Likewise, as the height of the carpet pile height is reduced, less force is required to maintain nozzle suction so carpet height selector 52 may be adjusted to reduce the force placed on agitator housing 53 through compression spring 55. It has been found that a force placed on agitator housing 53 in an amount equivalent to the weight of between one-half pound to two pounds in the direction of arrow 80 has been effective in restoring nozzle suction lost due to the suction nozzle being be lifted by the pile of carpets. However, this is in no way meant to be limiting as the actual amount of force varies from carpet to carpet according to pile height, pile type, and other factors. The characteristics of compression spring 55 are chosen such that compression spring 55 will place a force in this range on agitator housing 53. The actual amount of force is determined by the amount of force placed onto compression spring 55 by the cammed portion on the underside of carpet height selector 52. Foot assembly 50 is also equipped with an agitator shutoff assembly 61 on hood 51 which disengages rotary power from the agitator 63 when put in the off position.

The floating nozzle design allows the force being applied to agitator housing 53 to be maintained even as bag housing 30 is pivoted about foot 50 in the direction of arrow 81. In an alternate embodiment of the present invention, the power drive unit 70 has been omitted and replaced with a pair of conventional wheels for supporting the front portion of foot 50 on a surface. Loading spring arm 72 may be attached directly to main body 56 or other suitable attachment point within the interior of foot 50.

Figure 4:
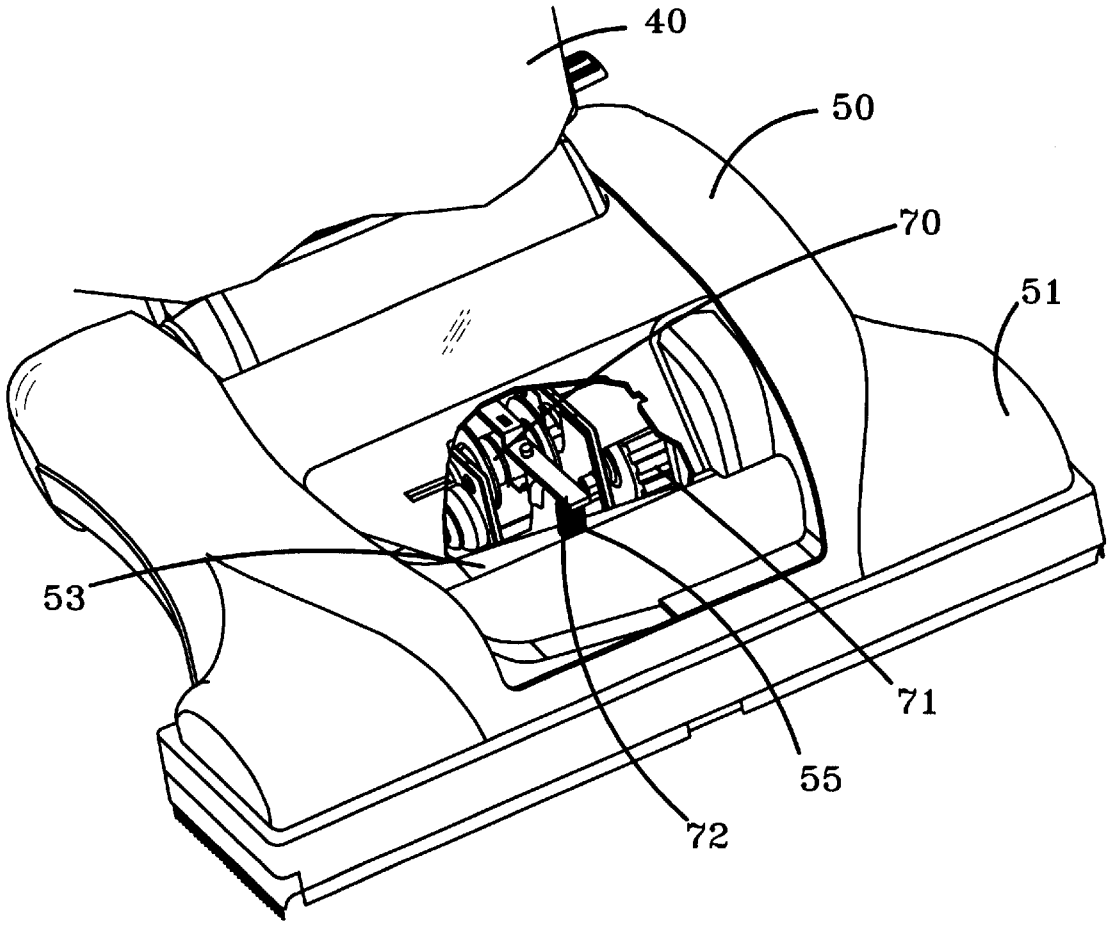
FIG. 4 is a perspective view of the vacuum cleaner of FIG. 1 with a portion of the hood cutaway in the region surrounding the agitator housing loading spring.
Figure 5:
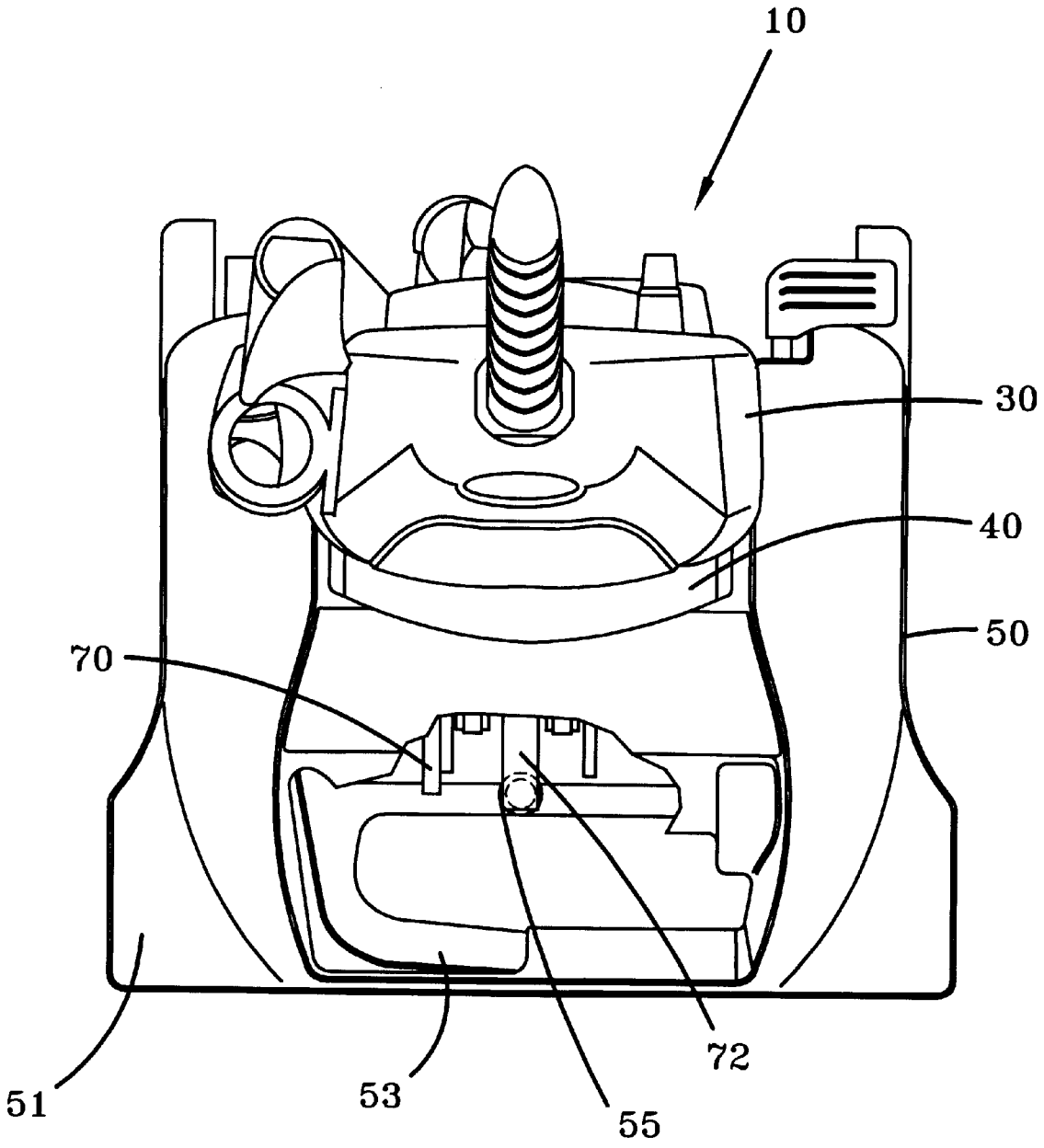
FIG. 5 is a top view of the vacuum cleaner of FIG. 1 with a portion of the hood cutaway in the region surrounding the agitator housing loading spring.

Referring now to FIG. 4, compression spring 55 is seen through a cutaway portion in the top of hood 51. A portion of the track which carpet selector 52 (not shown) slides in is seen to the left of the cutaway area. Loading spring arm 72 is seen attached to power drive unit 70 and extends over agitator housing 53 to provide a fixed point for the top end of compression spring 55 to bias against and to transmit the downward force from the cammed portion on the underside of the carpet selector 52 (not shown) to spring 51. This is also demonstrated in a top view in FIG. 5.

Referring now to FIG. 6, a lower portion of a vacuum cleaner having a spring-loaded nozzle of the fixed nozzle type is shown and is generally indicated as 110, according to an alternate embodiment of the present invention. The portion of the cleaner 110 shown is of an upright vacuum cleaner but the scope of the invention in the alternate embodiment also includes other vacuum cleaners having a fixed suction nozzle, including but not limited to, canister vacuums. Such cleaners generally have a suction nozzle portion having a nozzle inlet area for placement over the surface to be cleaned and an upright portion pivotally connected to the suction nozzle portion. The vacuum cleaner 110 shown in FIG. 6 includes a bag housing 130, a motor housing 140 and a foot 150. Foot 150 is comprised of an agitator housing 153, a wheel carriage 170, and hood 151. Bag housing 130 holds a filter media and receptacle 131 for filtering and collecting particulate matter from an airstream drawn into a suction nozzle inlet area **153*b* on the underside of foot 150 by a suction motor 141 located in motor housing 140. In the preferred embodiment of the invention, the filter media and receptacle 131 located within bag housing 130 is a filter bag. In an alternate embodiment of the present invention, the filtering media and receptacle 131 is cyclonic action and a dirt cup. In another alternate embodiment of the invention, the filtering media and receptacle 131 is a filter and a dirt cup. The suction nozzle inlet opening 153*b* opens toward the floor surface to be cleaned. A conventional agitator 163 is positioned within an agitator chamber 153*a* which communicates with the nozzle inlet opening 153*b*. The agitator rotates about a horizontal axis for loosening dirt from the carpet which is directed to filter media and receptacle 131. Foot 150 is pivotally connected to bag housing 130 via a pair of opposing trunnions 141 located on opposing sides of motor housing 140. Trunnion 141 fits into trunnion recess 157 and is secured therein by trunnion cover 159. Trunnion cover 159 is secured to agitator housing 153 with screws or the like. Trunnion recesses 157 and trunnion covers 159 are semi-circular in shape so that trunnion 141 is free to rotate therein. Before trunnions 141 are placed into trunnion recesses 157, a torsional spring 155 is installed inside the hollow interior of either of trunnions 141 or both. For illustrative purposes, only one torsional spring 155 is shown being installed in trunnion 141 located on the right side of the cleaner 110. Further detail of the installation of torsion spring 155 in trunnion 141 is given below in the description of FIGS. 7*a*, 7*b* and 8. A pair of wheels 160 are located on opposing sides of agitator housing 153 towards the rear for supporting the rear of agitator housing 153 on a surface. A wheel carriage assembly 170 having a pair of opposing wheels 171 is attached to the forward portion of agitator housing 153 to support the forward end of agitator housing 153 on a surface. Hood 151 is attached to the upper side of agitator housing 153. A carpet height selector 152 is located on the upper side of hood 151 and is mechanically connected with wheel carriage assembly 170. Wheel assembly carriage 170 is designed so that the wheels 171 can be raised and lowered in height relative to the wheel carriage 170 by sliding carpet height selector 152 laterally. This allows the height in which agitator housing 153 is raised above the surface to be cleaned to be adjusted. However, as with floating type nozzles, there still exists the problem of the foot 150 and the nozzle (not shown) being forced upward by the carpet as the carpet pile height increases. Foot assembly 150 is also equipped with an agitator shutoff assembly 161 on hood 151 which disengages rotary power from the agitator 163** when put in the off position.

Figure 6A:
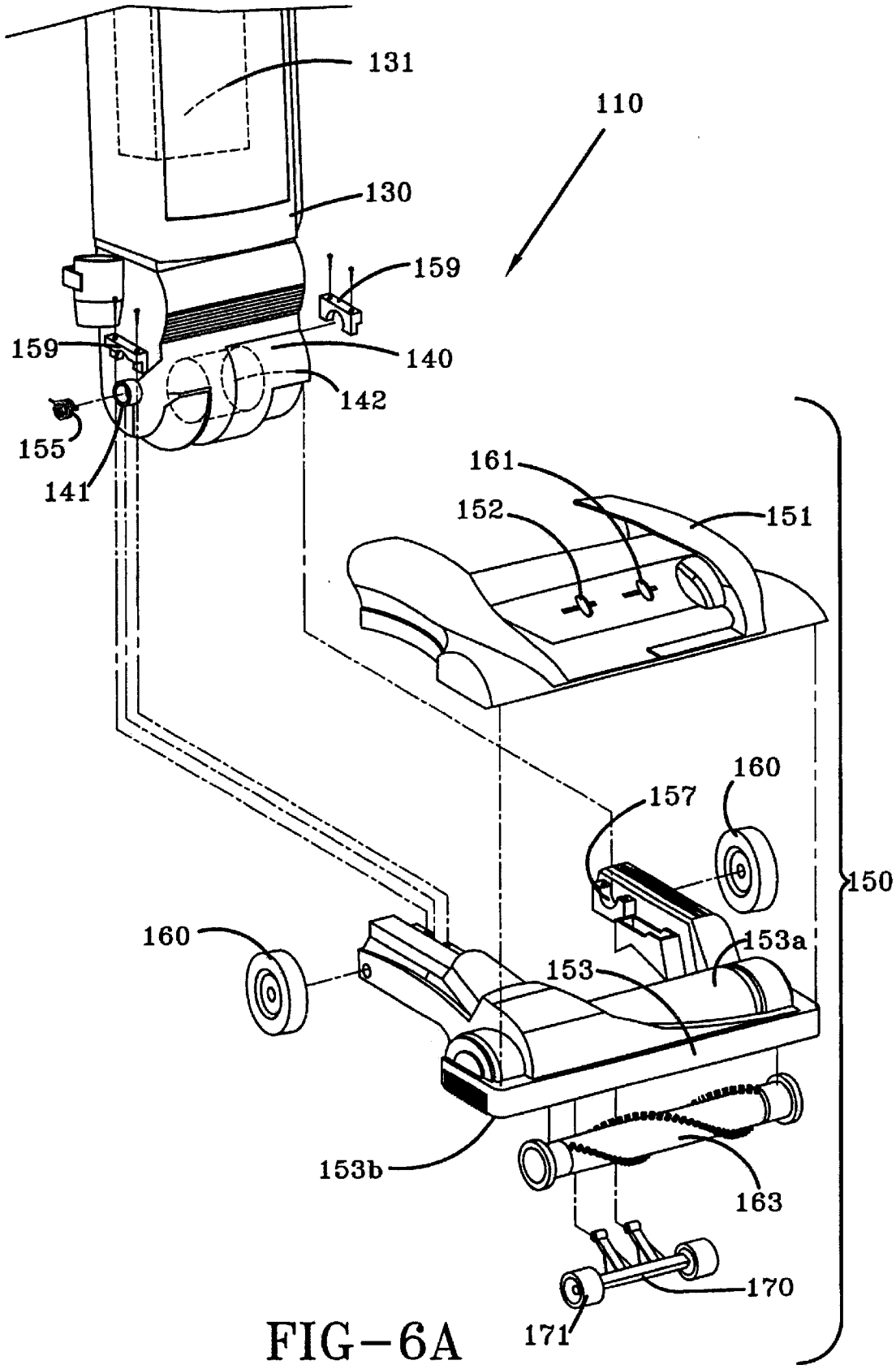
FIG. 6A is an exploded perspective view of the lower portion of a vacuum cleaner of fixed nozzle type found in a vacuum cleaner such as the one seen in FIG. 1, according to the second embodiment of the present invention.
Figure 6B:
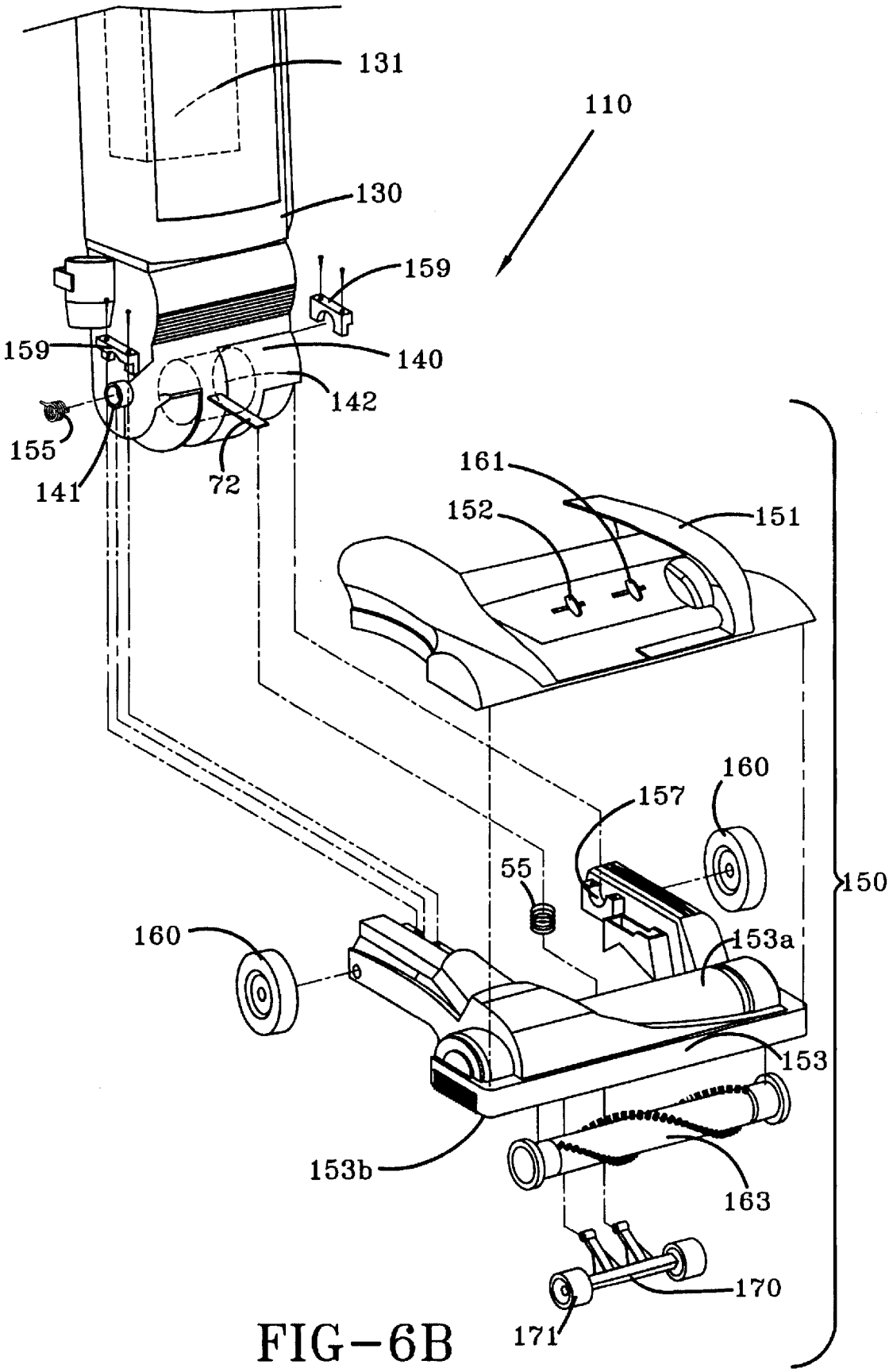
FIG. 6B is an exploded perspective view of the lower portion of a vacuum cleaner of fixed nozzle type found in a vacuum cleaner such as the one seen in FIG. 1, according to the sixth embodiment of the present invention.
Figure 7A:
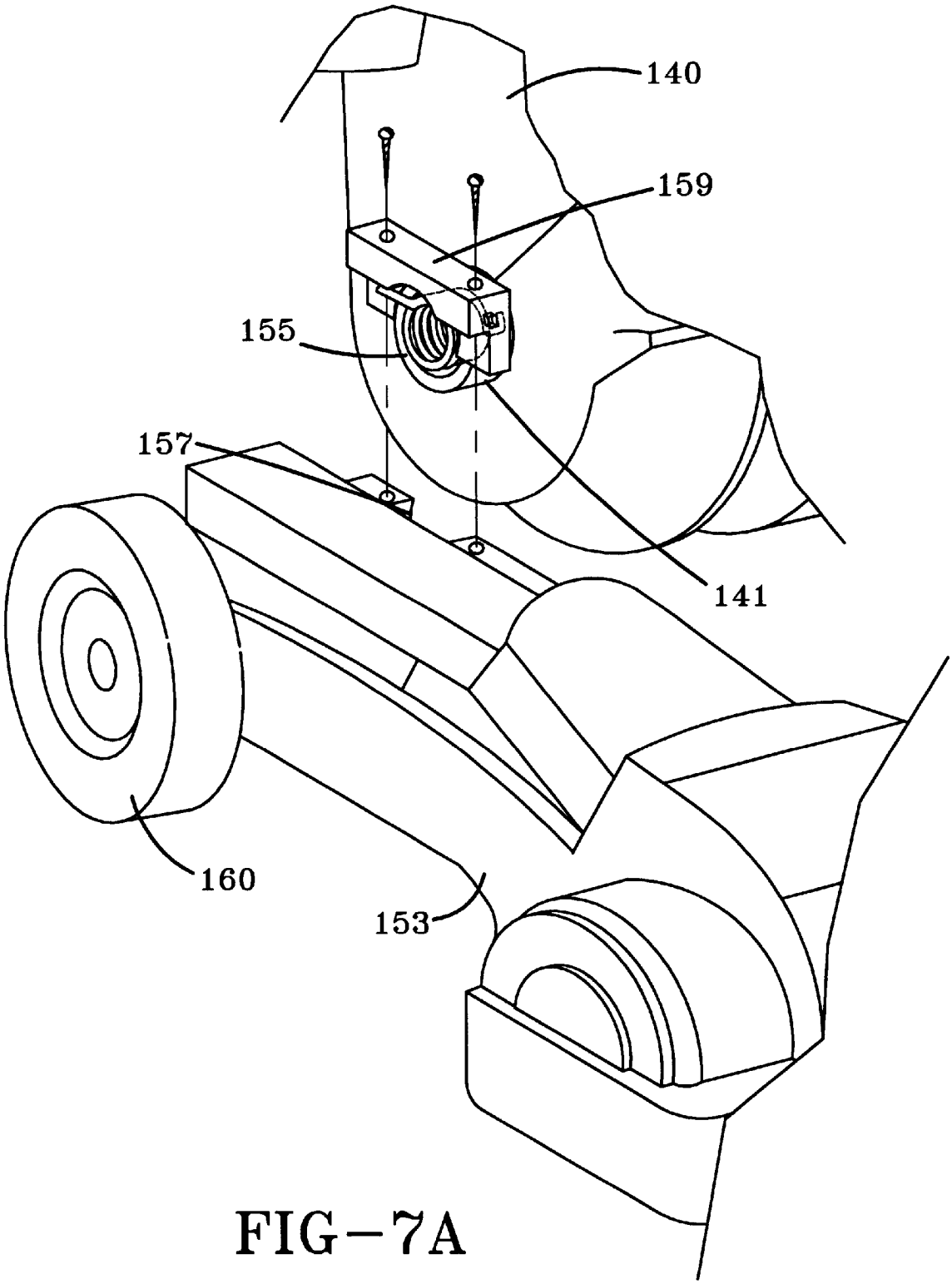
FIG. 7A*a* is an exploded perspective and partially cutaway view of a portion of the right side of the foot and motor housing of the vacuum cleaner shown in FIG. 6.
Figure 7B:
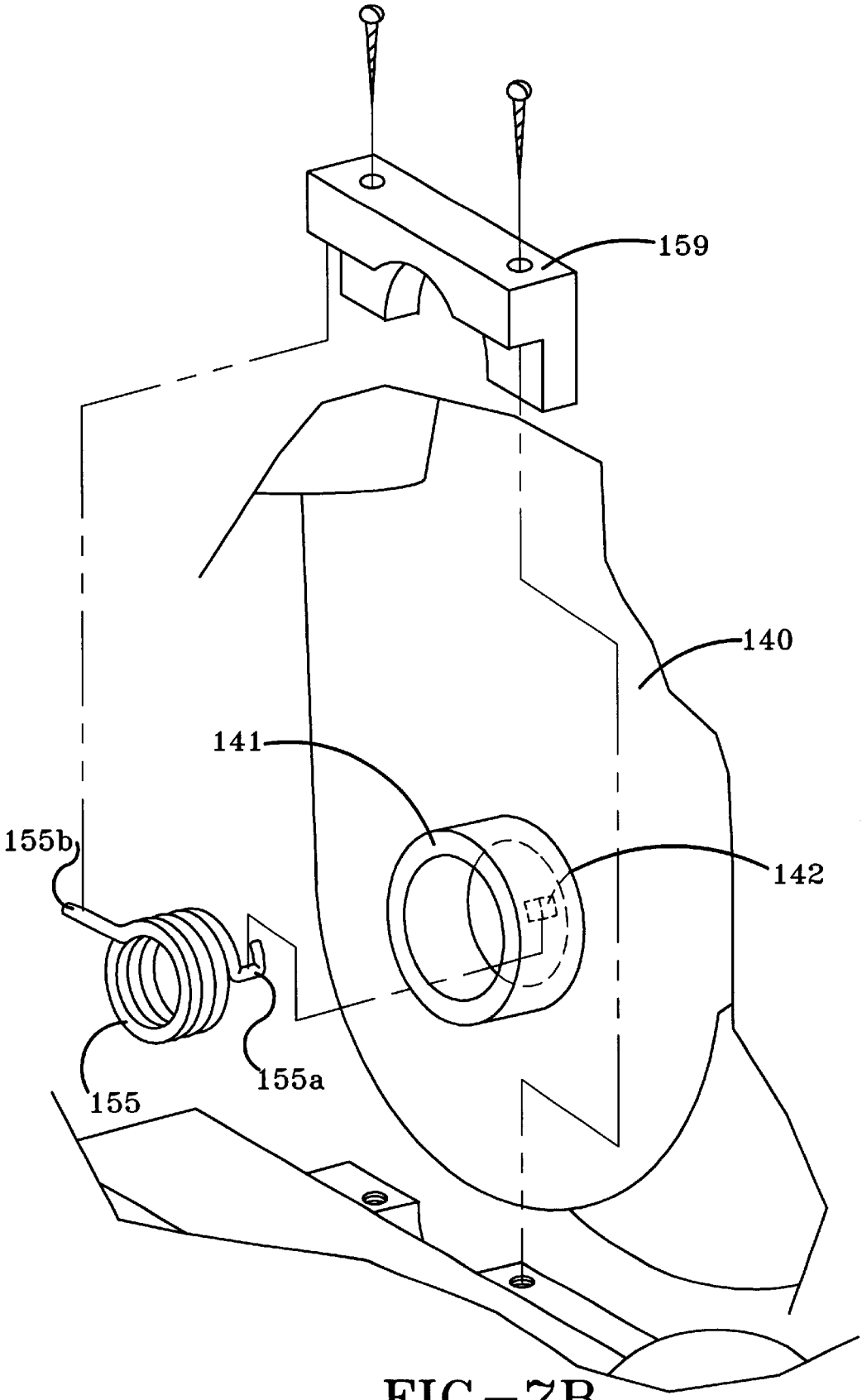
FIG. 7B is a fully exploded perspective and partially cutaway view of a portion of the right side of the foot and motor housing of the vacuum cleaner shown in FIG. 6 showing the detail of the installation of a torsional spring inside a trunnion.
Figure 8:
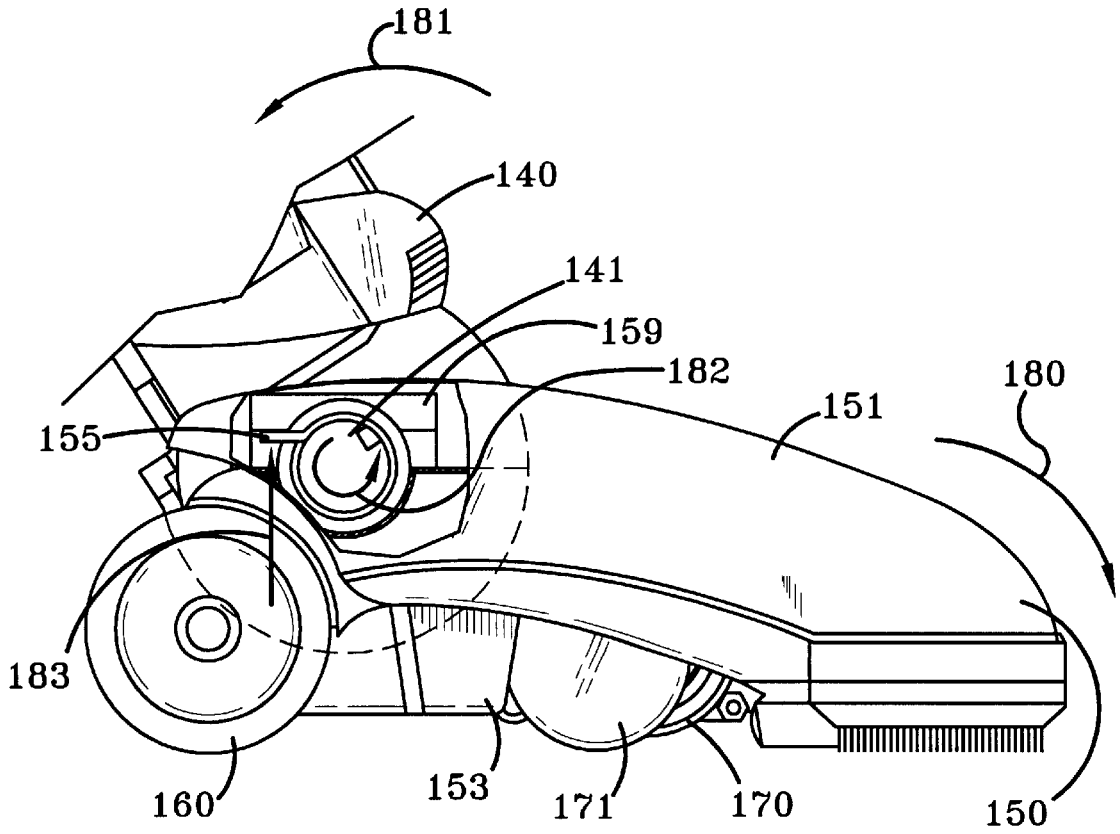
FIG 8 is a side view of the vacuum cleaner shown in FIG. 6.

Referring now to FIGS. 7*a*, 7*b* and 8, torsional spring 155 is installed inside trunnion 141 such that one of its free ends is secured to trunnion 141 by inserting it into a specially formed notch 142 in the sidewall of trunnion 141. Trunnion 141 is annular in shape and has an annular recess specially formed therein to receive torsional spring 155. One of the free ends 159*a* (FIG. 7*b*) of torsional spring 155 may also be prevented from rotating by being placed into a specially formed groove 142 on the inner circumference of trunnion 141. Torsional spring 155 may have a slight hook formed on the aforementioned free end 159*a* to engage notch 142. In an alternate embodiment, the aforementioned free end 159*a* may also be straight and engage a specially formed groove on the inner circumference of the recess of trunnion 141. The other free end 159*b* of torsional spring 155 extends outside of trunnion 141 and is sandwiched between the rear side of trunnion cover 159 and agitator housing 153. Thus, when trunnion cover 159 is installed, both of the free ends 159*a* and 159*b* of torsional spring 155 are prevented from rotating. Torsional spring 155 is installed such that the potential energy stored in torsional spring 155 is at its greatest when bag housing 130 is in the most upright position. A force in the direction of arrow 183 is created by the free end of torsional spring 155 sandwiched between trunnion cover 159 and agitator housing 153. This creates a torque on agitator housing 153 and foot 151 in the direction of arrow 180, urging the suction nozzle inlet area 153*b* underneath the front end of foot 151 into the carpet pile. When bag housing 130 (shown in FIG. 6) is pivoted in the direction of arrow 181, trunnion 141 grips the attached end 159*a* of torsional spring 155 and causes a rotation of torsional spring 155 in the direction of arrow 182. Thus, some of the potential energy is stored in torsional spring 155 is released. However, there still remains enough potential energy in torsional spring 155 to create a torque about trunnion 141 in the direction of arrow 180 to urge agitator housing 153 downwardly as the carpet pile tends to force agitator housing 153 upwardly from the surface of the carpet. Torsional spring 155 is selected for its elastic properties such that it produces a torque when bag housing 130 is in the rearmost position and a force in the direction of arrow 180 equivalent to one-half pound to two pounds. As discussed, that amount of force has been found to be effective in restoring nozzle suction lost due to the suction nozzle being lifted by the increasing pile height of carpets. However, this is in no way meant to be limiting as the actual amount of force varies from carpet to carpet according to pile height, type of pile, and other factors. When bag housing 130 is restored to the normal upright position, the potential energy in torsional spring 155 and the torque placed on agitator housing 153 is restored to their maximum value.

In a third embodiment of the present invention (FIG. 2B), compression spring 55 and loading spring arm 72 are replaced in a vacuum cleaner such as the one shown in FIGS. 1 to 5 with one or more torsional springs installed onto pivot(s) 54, or alternately, inside trunnion(s) 41. The installation of a torsional spring(s) is similar to the installation of a torsional spring into trunnion(s) 141 of the vacuum cleaner shown in FIGS. 6A to 8. The torsional spring(s) urge the front of foot 51 downward in the direction of arrow 80 shown in FIGS. 3A–B.

In a fourth embodiment of the present invention (FIG. 2C), one or more torsional springs like the one seen in FIG. 6A are added to a cleaner such as the one shown in FIGS. 1 to 5 in addition to compression spring 55. The additional torsional spring(s) are installed inside of one or both of trunnions 41 to urge main body 56 away from bag housing 30 which tends to assist compression spring 55 in urging agitator housing 53 towards the floor surface. Alternately, one or more torsional springs can be installed onto one or both of opposing pivots 54 in the manner described in the third embodiment. The added torsional spring(s) aids compression spring 55 in urging agitator housing 53 and the front of foot 51 downward in the direction of arrow 80 shown in FIGS. 3A–B.

In a fifth embodiment of the present invention (FIG. 2D), power drive unit 70 is eliminated and replaced with a wheel carriage having pair of conventional wheels for supporting the front portion of foot 50 on a surface. Loading spring arm 72 may is attached directly to main body 56 or other suitable attachment point within the interior of foot 50. Compression spring 55 is installed in operative engagement with loading spring arm 72 and agitator housing 53 as previously described. In addition to compression spring 55, one or more torsional springs like the one seen in FIG. 6A can be added to a cleaner such as the one shown in FIGS. 1 to 5. The additional torsional spring(s) are installed inside of one or both of trunnions 41 to assist compression spring 55 in urging agitator housing 53 towards the floor surface. Alternately, one or more torsional springs can be installed onto one or both of opposing pivots 54 in the manner described in the third embodiment. The added torsional spring(s) aids compression spring 55 in urging agitator housing 53 and the front of foot 51 downward in the direction of arrow 80 shown in FIGS. 3A–B.

Figure 3A:
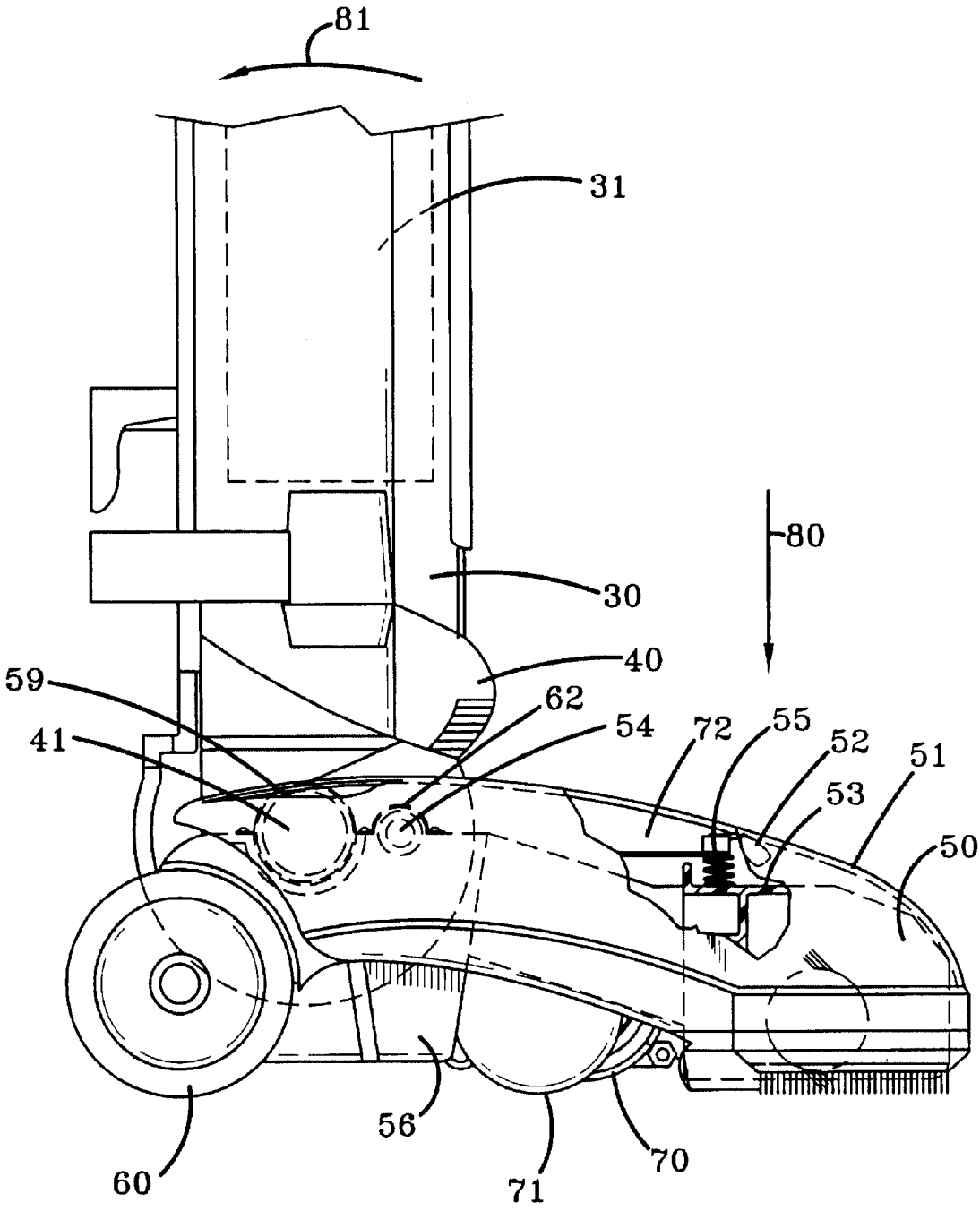
FIG. 3A is a side view of the vacuum cleaner of FIG. 1 with a cutaway view of the region surrounding the agitator housing loading spring.
Figure 3B:
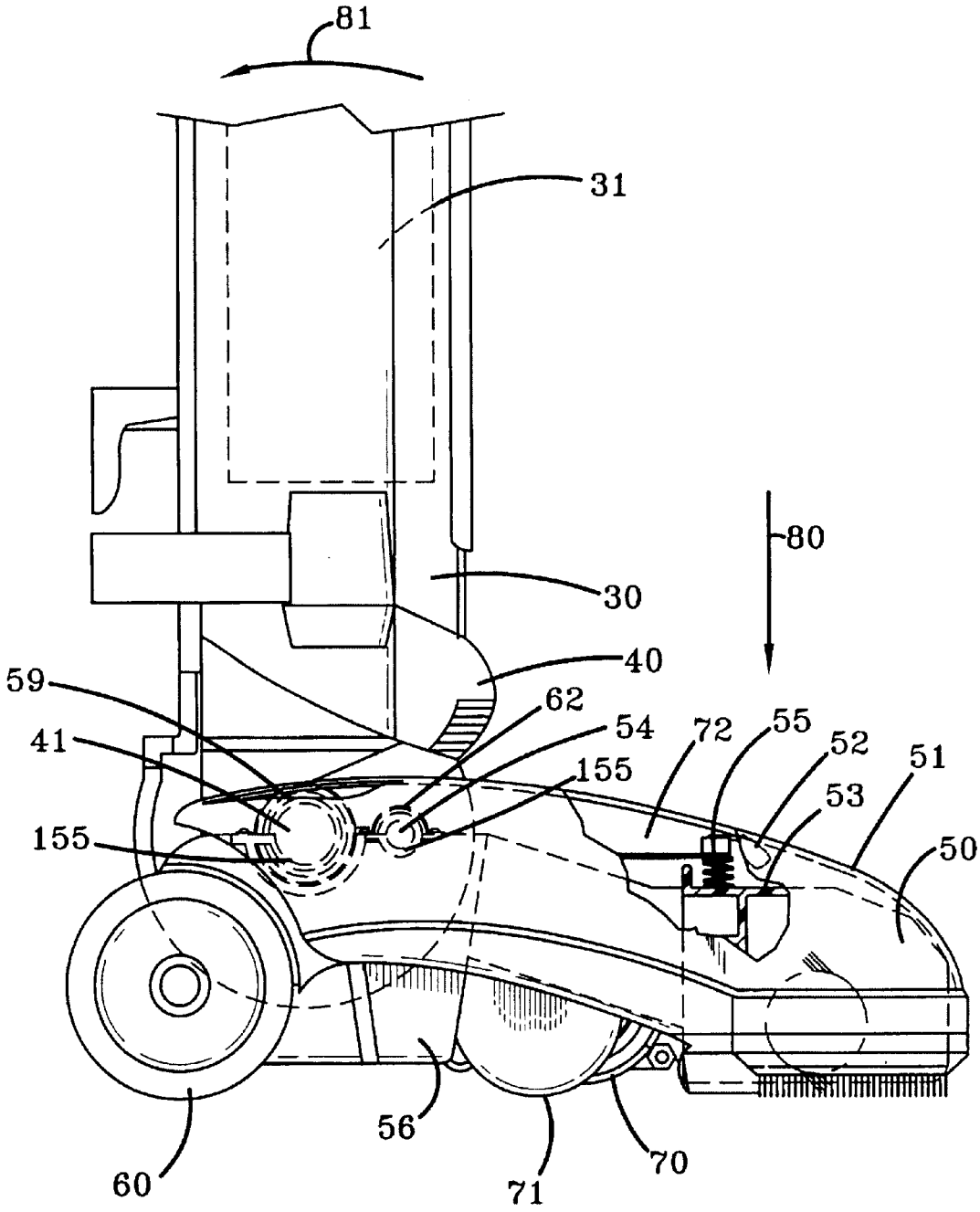
FIG. 3B is a side view of the vacuum cleaner of FIG. 1 with a cutaway view of the region surrounding the agitator housing loading spring found in the preferred embodiment of the invention and the location of the torsional springs found in the third, fourth and fifth embodiments of the present invention.
Figure 3C:
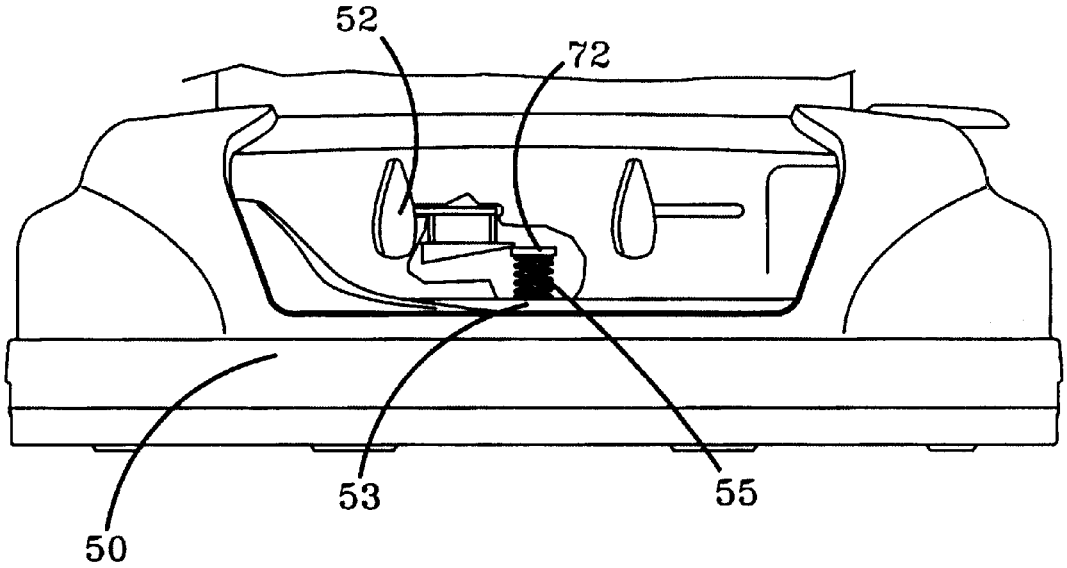
FIG. 3C is a front view of the foot portion of the vacuum cleaner of FIG. 1 with a cutaway view of the region surrounding the agitator housing loading spring with the carpet height selector in the highest carpet height position.
Figure 3D:
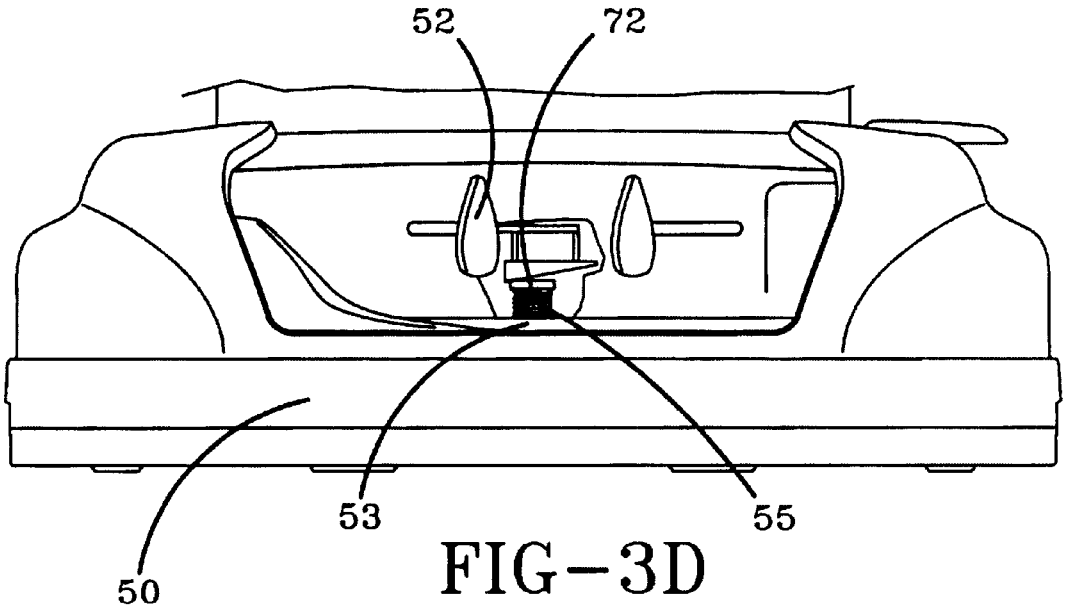
FIG. 3D is a front view of the foot portion of the vacuum cleaner of FIG. 1 with a cutaway view of the region surrounding the agitator housing loading spring with the carpet height selector in the lowest carpet height position.

In a sixth embodiment of the present invention, a compression spring and a spring loading arm such as those found in the invention described in FIGS. 1 to 5 are installed on a vacuum cleaner such as the one shown in either of FIGS. 1 to 5 (FIG. 2E) or FIGS. 6A to 8 (FIG. 6B) in the area just in front of the motor housing designated as numeral 40 in FIG. 3A. The arrangement functions identically to the arrangement described in FIGS. 1 to 5 with the exception that the compression spring and spring loading arm bias foot 50 against bag housing 30 downward toward the floor surface to urge agitator housing 53 and agitator 63 into the carpet pile. Such an arrangement may or may not be used in combination with a nozzle height selector such as the one shown on the preferred embodiment shown in FIGS. 1 to 5.

Accordingly, while there has been shown and described herein several embodiments of the present invention, it should be readily apparent to persons skilled in the art that numerous modifications may be made therein without departing from the true spirit and scope of the invention. Accordingly, it is intended for the appended claims to cover all such modifications that come within the spirit and scope of the invention.

What is claimed is:

1. A vacuum cleaner comprising:

an agitator housing including an agitator chamber opening into a suction nozzle inlet area for operative engagement with a surface to be cleaned such as carpet;

an agitator mounted within said agitator chamber;

a main body pivotally supporting said agitator housing over the surface to be cleaned with said agitator housing being pivotally connected thereto so that the height of the suction nozzle relative to the surface to be cleaned may be varied;

a nozzle height selector mounted on said main body and capable of being moved laterally thereon through a plurality of positions for varying the height of said agitator housing relative to the surface to be cleaned;

a spring member in operative engagement with said nozzle height selector and said agitator housing for biasing said agitator housing away from said main body for urging said agitator housing and said agitator mounted therein toward the surface to be cleaned or into the carpet pile.

2. The vacuum cleaner of claim 1 wherein said spring member places an equivalent force in the range of one-half to two pounds on said agitator housing for urging said agitator housing and said agitator mounted therein toward said floor surface or into the carpet pile.

3. The vacuum cleaner of claim 2 wherein said spring member is a compression spring.

4. The vacuum cleaner of claim 3 further including a power drive unit attached to said main body and fitted into a rear side of said agitator housing for propelling said main body and said agitator housing over the surface to be cleaned or the carpet.

5. The vacuum cleaner of claim 4 wherein said power drive unit further includes a loading spring arm projecting forwardly from said power drive unit over onto an upper surface of said agitator housing and an upper side of said loading spring arm bears against an underside of said nozzle height selector.

6. The vacuum cleaner of claim 5 wherein an underside of said nozzle height selector is cammed so that as said nozzle height selector is moved laterally the amount of force being applied to said compression spring via said loading spring arm is varied according to the height of the carpet so that an appropriate amount of force can be applied to the upper surface of said agitator housing to urge said agitator housing and said agitator mounted therein towards the carpet to maintain suction therebetween.

7. The vacuum cleaner of claim 6 further including a torsional spring for aiding said compression spring in urging said agitator housing toward the surface to be cleaned or into the carpet pile.

8. The vacuum cleaner of claim 7 wherein said torsional spring is installed over at least one of said pair of pivots for biasing said agitator housing away from said main body and urging said agitator housing toward the surface to be cleaned and into the carpet pile.

9. The vacuum cleaner of claim 7 further including a bag housing, a motor housing located at the lower end of said bag housing, and a pair of trunnions located on opposing sides of said motor housing for pivotally connecting said main body to said motor housing.

10. The vacuum cleaner of claim 7 further including a torsional spring installed on at least one of said pair of trunnions for biasing said main body away from said motor housing.

11. A vacuum cleaner according to claim 3 further including a loading spring arm projecting forwardly from said main body over onto an upper surface of said agitator housing and an upper side of said loading spring arm bears against an underside of said nozzle height selector.

12. The vacuum cleaner of claim 3 wherein an underside of said nozzle height selector is cammed so that as said nozzle height selector is moved laterally the amount of force being applied to said compression spring via said loading spring arm is varied according to the height of the carpet so that an appropriate amount of force can be applied to the upper surface of said agitator housing to urge said agitator housing and said agitator mounted therein towards the carpet to maintain suction therebetween.

13. The vacuum cleaner of claim 12 wherein an underside of said carpet height selector is cammed so that as said carpet height selector is moved laterally the amount of force being applied to said compression spring via said loading spring arm is varied according to the height of the carpet so that an appropriate amount of force can be applied to the upper surface of said agitator housing to urge said agitator housing and said agitator mounted therein towards the carpet to maintain suction therebetween.

14. The vacuum cleaner of claim 13 further including a torsional spring for aiding said compression spring in urging said agitator housing toward the surface to be cleaned or into the carpet pile.

15. The vacuum cleaner of claim 14 further including a pair of pivots located on opposing sides of said agitator housing for pivotally connecting said agitator housing to said main body.

16. The vacuum cleaner of claim 15 wherein said torsional spring is installed on at least one of said pair of pivots for biasing said agitator housing downward against said main body and urging said agitator housing toward the surface to be cleaned and into the carpet pile.

17. The vacuum cleaner of claim 14 further including a bag housing, a motor housing located at the lower end of said bag housing, and a pair of trunnions located on opposing sides of said motor housing for pivotally connecting said main body to said motor housing.

18. The vacuum cleaner of claim 17 further including a torsional spring installed inside at least one of said pair of trunnions for biasing said main body away from said motor housing.

19. A vacuum cleaner comprising:

a vacuum cleaner foot pivotally connected to a housing about a pivot axis;

an agitator housing including an agitator chamber opening into a suction nozzle inlet area for operative engagement with a surface to be cleaned such as carpet;

an agitator mounted within said agitator chamber;

a main body pivotally supporting said agitator housing over the surface to be cleaned with said agitator housing being pivotally connected thereto about an axis which does not coincide with the pivot axis of said vacuum cleaner foot and said housing;

at least one spring member urging said agitator housing downward toward the surface to be cleaned or into the carpet pile.

20. The vacuum cleaner of claim 19 wherein said spring member places an equivalent force in the range of one-half to two pounds on said agitator housing for urging said agitator housing and said agitator mounted therein toward said floor surface or into the carpet pile.

21. The vacuum cleaner of claim 20 further including a pair of pivots located on opposing sides of said agitator housing for pivotally connecting said agitator housing to said main body.

22. The vacuum cleaner of claim 21 wherein said at least one spring member is a torsional spring installed on at least one of said pair of pivots for biasing said agitator housing away from said main body.

23. The vacuum cleaner of claim 20 further including a bag housing, a motor housing located at the lower end of said bag housing, and a pair of trunnions located on opposing sides of said motor housing for connecting said motor housing to said main body.

24. The vacuum cleaner of claim 23 further including a torsional spring installed inside at least one of said pair of trunnions for biasing said main body away from said bag housing.

25. A vacuum cleaner comprising:

a bag housing;

a motor housing located on a lower end of said bag housing including a pair of trunnions located on opposing sides of said motor housing;

an agitator housing pivotally connected to said motor housing via said pair of trunnions, said agitator housing having an agitator chamber opening into a suction nozzle inlet area for operative engagement with a surface to be cleaned such as carpet;

an agitator mounted in said agitator chamber; and at least one spring member mounted on at least one of said pair of trunnions for biasing said agitator housing away from said motor housing for urging said agitator housing and said agitator mounted in said agitator chamber toward a surface to be cleaned or into the carpet pile.

26. The vacuum cleaner of claim 25 wherein said at least one spring member places an equivalent force in the range of one-half to two pounds on said agitator housing for urging said agitator housing and said agitator mounted therein toward the surface to be cleaned and the carpet pile.

27. The vacuum cleaner of claim 26 wherein said at least one spring member is a torsional spring.

28. The vacuum cleaner of claim 26 further including at least one loading spring arm mounted on said motor housing.

29. The vacuum cleaner of claim 28 wherein said at least one spring member is a compression spring in operative engagement with one of said at least one loading spring arms.

30. A vacuum cleaner comprising:

a bag housing;

a motor housing located on a lower end of said bag housing including a pair of trunnions located on opposing sides of said motor housing;

an agitator housing pivotally connected to said motor housing via said trunnions, said agitator housing having an agitator chamber opening into a suction nozzle inlet area for operative engagement with a surface to be cleaned such as carpet;

an agitator mounted in said agitator chamber;

at least one spring member for biasing said agitator housing away from said motor housing for urging said agitator housing and said agitator mounted therein toward a surface to be cleaned or into the carpet pile; and at least one loading spring arm mounted on said motor housing in operative engagement with said at least one spring member.

31. The vacuum cleaner of claim 30 wherein said at least one spring member is a compression spring.

32. The vacuum cleaner of claim 30 wherein said at least one spring member places an equivalent force in the range of one-half to two pounds on said agitator housing for urging said agitator housing and said agitator mounted in said agitator toward the surface to be cleaned and the carpet pile.

* * * * *